US005078331A

United States Patent [19]

Mardix et al.

[11] Patent Number: 5,078,331

[45] Date of Patent: Jan. 7, 1992

[54] SEWING MACHINE BOBBIN AND MINI-SPOOL ROTATABLY MOUNTED THEREON

[75] Inventors: Bar C. Mardix, Tel Aviv; Yaacov Sadeh, Nes Ziona; Yaacov Makover, Elazari, all of Israel

[73] Assignee: Orisol Original Solutions, Ltd., Lod, Israel

[21] Appl. No.: 599,960

[22] Filed: Oct. 19, 1990

[30] Foreign Application Priority Data

Oct. 20, 1989 [IL] Israel ..... 92066

[51] Int. Cl.[5] ..... B65H 75/14

[52] U.S. Cl. ..... 242/118.41; 112/273

[58] Field of Search ..... 112/273, 278, 275, 277, 112/228, 231; 242/37 R, 118, 118.41, 118.4

[56] References Cited

U.S. PATENT DOCUMENTS

| | | | |
|---|---|---|---|
| 2,340,574 | 2/1944 | Ashworth | 242/118.41 |
| 3,991,692 | 11/1976 | Papajewski et al. | 112/278 |
| 4,824,041 | 4/1989 | Myers | 242/118.41 |
| 4,934,292 | 6/1990 | Mardix et al. | 112/273 |

*Primary Examiner*—Peter Nerbun

*Attorney, Agent, or Firm*—Benjamin J. Barish

[57] ABSTRACT

A sewing machine bobbin includes a mini-spool rotatably mounted on the bobbin for receiving a predetermined length at the inner end of the thread such that when the bobbin stops rotating, the mini-spool may continue to rotate to pay out a part of a predetermined length of thread in order to finish a stitching operation.

4 Claims, 4 Drawing Sheets

SEWING MACHINE BOBBIN AND MINI-SPOOL ROTATABLY MOUNTED THEREON

FIELD AND BACKGROUND OF THE INVENTION

The present invention relates to sewing apparatus including an arrangement for automatically monitoring the bobbin thread, and also to a bobbin particularly useful in such apparatus.

The known sewing machines are provided with various means for feeding an upper thread to the sewing needle, and other means, including a bobbin, for feeding the lower thread to the sewing needle. Monitoring the condition, particularly breakage, of the upper thread is relatively simple, and several methods are in use today, as described for example in U.S. Pat. No. 3,843,883. However, monitoring the condition of the lower bobbin thread is somewhat more problematical, and although a number of systems have been devised for doing this, the known systems are still not entirely satisfactory. The main reason for this is because of the complexity of the path of the lower thread out of the bobbin, which enables very little room for detection. Various methods for detecting an empty bobbin condition using a light beam are known, for example as described in U.S. Pat. Nos. 4,237,807 and 4,212,257, and in British Patents 1,335,677 and 2,078,798. However, these known techniques are usually of complicated construction and generally do not detect all the conditions of the bobbin thread, including thread exhaustion and thread breakage.

Our prior patent U.S. Pat. Nos. 4,934,292 discloses an arrangement for detecting when a bobbin stops rotating, e.g., because of an empty bobbin. The detection of this condition may be used for terminating the operation of the sewing machine to enable refilling or replacement of the empty bobbin and to continue with the stitching operations.

However, when a stitching operation is terminated in the middle because of an empty bobbin and is then resumed with a new bobbin, a break in the stitch appears. This is particularly unsightly in "top stitchings", such as collars, cuffs, pockets, etc., viewable from the outside of the garment, as distinguished from "inside stitches" which are not viewable from the outside of the garment.

OBJECTS AND BRIEF SUMMARY OF THE INVENTION

An object of the present invention is to provide a sewing machine bobbin particularly useful to permit a stitching operation to be completed even when the bobbin stops rotating. Other objects of the present invention are to provide sewing apparatus including an arrangement for automatically monitoring the feeding of the bobbin thread, for maintaining the thread relatively tight on the bobbin, and/or for facilitating rewinding of the thread on the bobbin upon thread exhaustion.

According to the present invention, there is provided a sewing machine bobbin comprising a pair of end walls interconnected at their centers by an axle for receiving thread wound on the axle, characterized in that the bobbin includes a rotatable mini-spool rotatably mounted on the bobbin for receiving a predetermined length of the inner end of the thread such that when the bobbin stops rotating, the mini-spool may continue to rotate to pay out part or all of the predetermined length of the thread thereon in order to finish a stitching operation.

More particularly, according to a preferred embodiment of the invention described below, the mini-spool is rotatably mounted on the bobbin axle and is of a width less than that of the bobbin axle. The bobbin axle is formed with an annular recess at one side to receive the mini-spool and to restrain it from moving axially of the bobbin.

The foregoing features of the present invention provides a bobbin structure which permits the bobbin, even when it stops rotating, to nevertheless supply a sufficient length of thread in order to finish a stitching operation. Thus, the use of such a bobbin prevents the unsightly break which normally is produced in a stitch when interrupted in the middle of a stitching operation.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
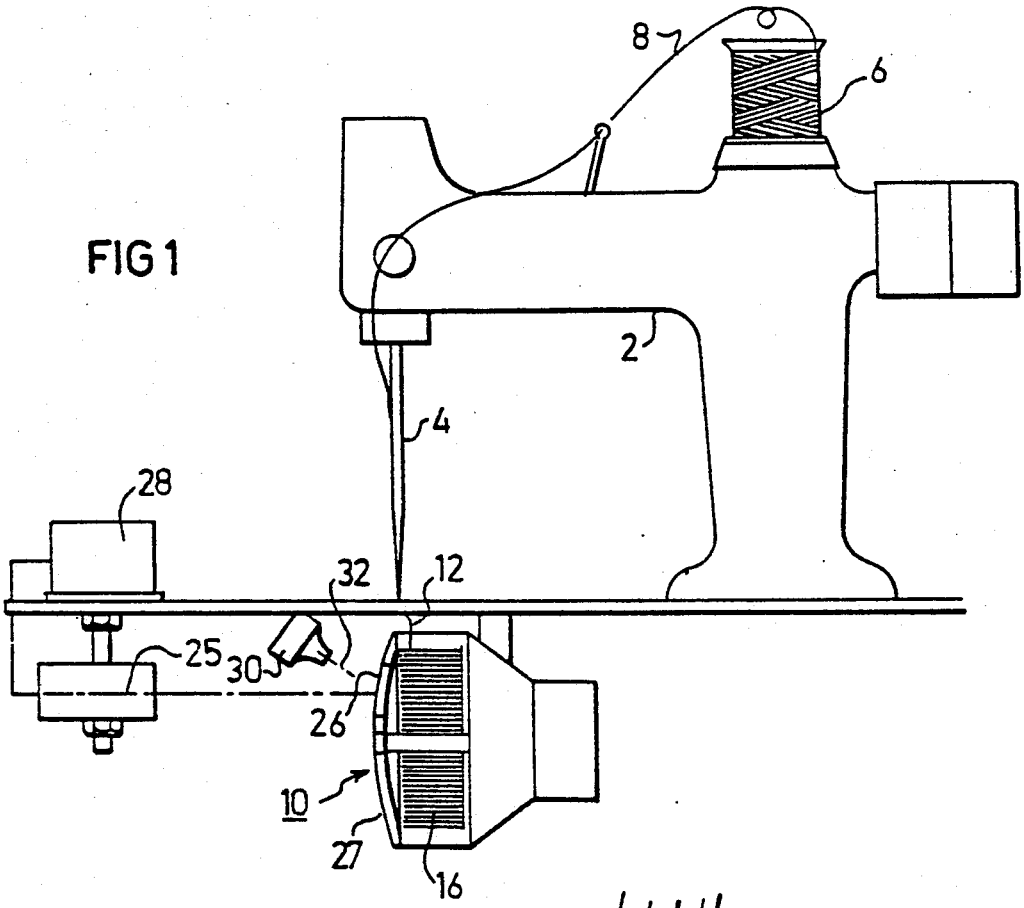
FIG. 1 is a side elevational view illustrating the main components of sewing apparatus equipped with a thread-monitoring device in accordance with the present invention.

With reference first to FIG. 1, there is illustrated a sewing machine head, generally designated 2, including a reciprocating sewing needle 4, a spool 6 for feeding an upper thread 8 to the sewing needle, and a lower-thread unit 10 for feeding the lower thread 12 to the sewing needle. The lower thread unit 10, as more particularly illustrated in FIG. 2, comprises a case 14, a bobbin 16 disposed within the case and containing a supply of the lower thread 12, and a rotary housing 18 which is rotated in synchronism with the reciprocation of the sewing needle 4, the pressure foot 20 and the other components of the sewing machine, so as to form stitches with the upper thread 8. The general construction and mode of operation of such sewing machines are well-known, and therefore further details not essential to an understanding of the present invention are not set forth herein.

The lower-thread, or bobbin-thread, unit 10 is provided with a monitoring device for monitoring the bobbin thread to indicate either a broken-thread or an exhausted-thread condition. In addition, unit 10 is also provided with an arrangement for maintaining the thread relatively tight on the bobbin, and with a further arrangement for facilitating rewinding the bobbin with an additional supply of thread when the original supply has become exhausted.

Figure 2:
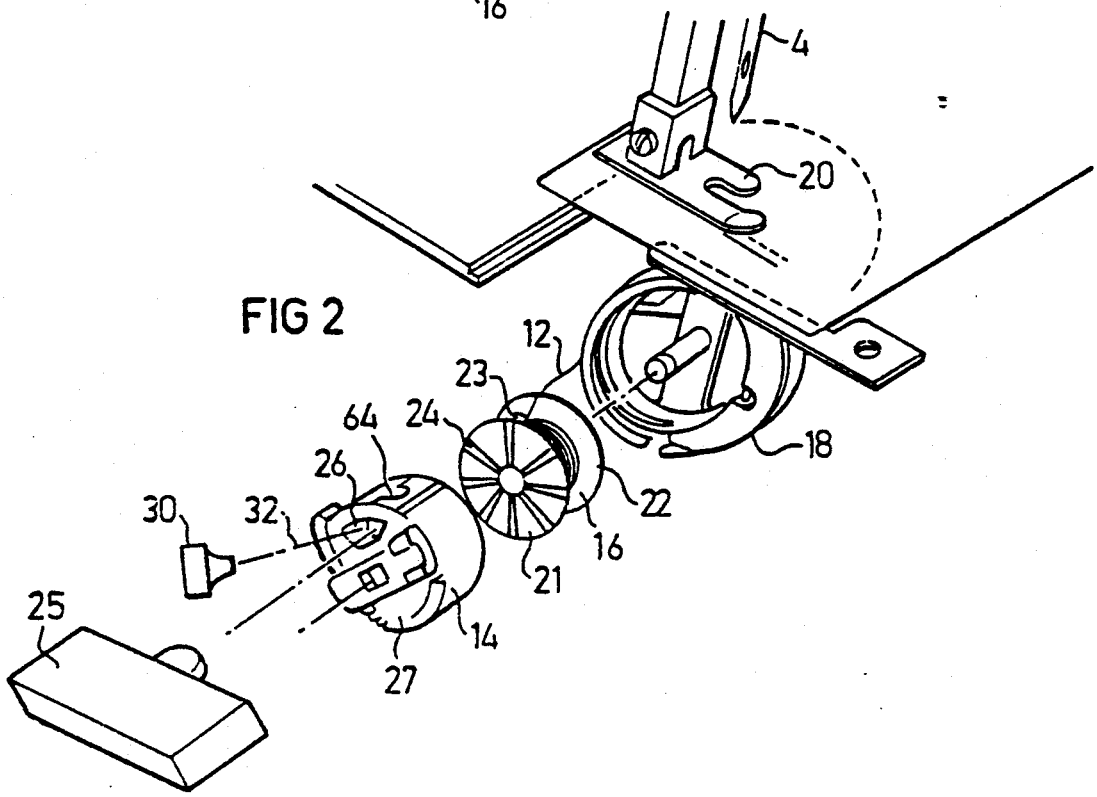
FIG. 2 is an exploded three-dimensional view illustrating the main components of the bobbin thread-monitoring device in the sewing apparatus of FIG. 1.
Figure 3:
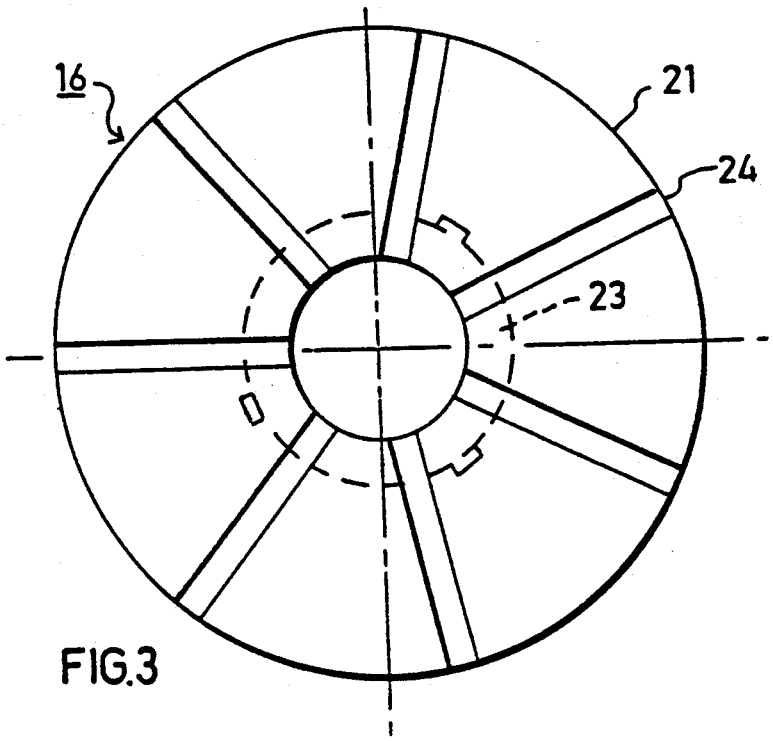
FIG. 3 is an enlarged side elevational view illustrating the end wall of the lower bobbin in the sewing apparatus of FIGS. 1 and 2.
Figure 4:
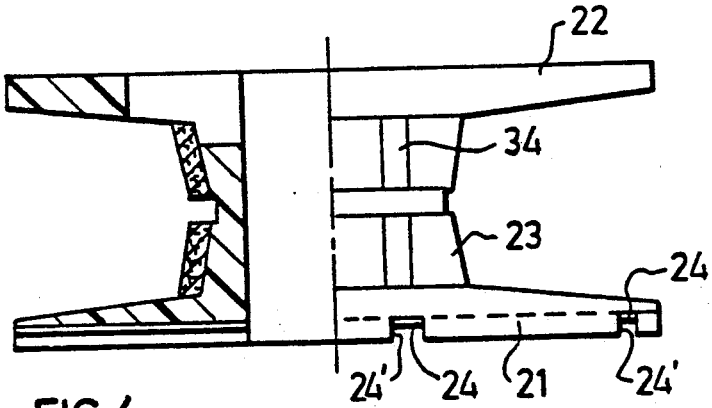
FIG. 4 is an end view, partly in section, illustrating the bobbin of FIGS. 1–3.

As shown particularly in FIGS. 2 and 4, the bobbin 16 is provided with a pair of end walls 21, 22 interconnected at their centers by an axle 23 for receiving the thread 12 wound on the axle. The outer face of one of the end walls 21 is formed with a plurality of radially-extending strips 24 of an optically-sensible material radiating from the center of the end wall. Thus, strips 24 may be of dark color (e.g., black) so as to be optically distinguishable from the lighter color (e.g., white) of the remainder of end wall 21. As shown in FIG. 3, each strip 24 has a width in the circumferential direction which is a small fraction of its length in the radial direction. Strips 24 are sensed by an optical sensor 25 aligned with an opening 26 in an end wall 27 of the bobbin case 14, as shown in FIG. 2. The arrangement is such that when bobbin 16 is rotating, stripes 24 on its end wall 21 generate, in optical sensor 25, a series of pulses which thereby indicate not only the fact that the bobbin is rotating, but also its rotary velocity.

The pulses generated by optical sensor 25 are fed to a unit 28 (FIG. 1) which may include an indicator for indicating whether or not the bobbin is rotating, and or its rotational velocity. Unit 28 may also include a control for automatically controlling the sewing machine in response to this information, e g., for automatically stopping the sewing machine should the bobbin cease to rotate, thereby indicating either a break in the bobbin thread or the exhaustion of the bobbin thread. Control unit 28 may also be effective, upon sensing a thread-breakage or a thread-exhaustion condition, to effect the automatic withdrawal of the bobbin and its replacement with another bobbin having a full supply of thread.

As shown particularly in FIG. 4, the colored stripes 24 formed in end wall 21 of the bobbin 16 are offset from the plane of the bobbin end wall 21. In the construction illustrated in FIG. 4, they are recessed within the end wall. By this construction, stripes 24 define a plurality of radially-extending vanes, schematically indicated at 24'. These vanes are impinged by an air jet from a nozzle 30 (FIGS. 1 and 2) aligned with opening 26 in the bobbin case 14. Nozzle 30 is oriented obliquely with respect to the axis of bobbin 16 so that the air jet 32 produced thereby impinges vanes 24' and applies a force tending to rotate the bobbin in the direction for tightening the thread 12 on the bobbin and to remove any slack therein. The amount of force produced by these vanes is sufficient only to take-up the play in the thread, and not sufficient to rotate the bobbin any significant amount against the frictional resistance in the bobbin drive.

It will thus be seen that opening 26 formed in bobbin case 14 serves two functions: It permits optical sensor 25 to monitor the bobbin 16 in order to detect whether or not the bobbin is rotating and also its rotational velocity; it also permits the air jet 32 produced by nozzle 30 to impinge the face of end wall 21 of the bobbin, particularly the vanes 24' formed by the recessed colored stripes 24, in order to apply a rotary force on the bobbin tending to tighten the thread thereon.

As further shown particularly in FIG. 4, axle 23 of the bobbin is provided on its outer face with a plurality of axially-extending strips 34 of a friction material, such as sandpaper or other material having a roughened surface, for catching the thread when the thread is to be automatically wound on the bobbin. Strips 34 are of a color which is optically distinguishable from the color of the remainder of the bobbin axle 23; for example, strips 34 may be of the color black, whereas the remainder of the bobbin axle 23 may be of the color white. Strips 34 may thus be used for optically detecting the rotation of an empty bobbin when thread is to be rewound thereon.

The operation of the illustrated sewing machine will be apparent from the above description. Thus, during the normal operation of the sewing machine, bobbin 16 will be rotating as it feeds thread 12 to the sewing needle 4. This condition will be monitored by optical sensor 25 which senses, via opening 26, the radially-extending stripes 24 formed on end wall 21 of the bobbin, and which thereby produces a train of pulses at a repetition rate corresponding to the rotational velocity of the bobbin. During the normal operation of the sewing machine, nozzle 30 produces an air jet 32 which passes through opening 26 of the bobbin case 14 and impinges against the recessed vanes 24' formed in the outer face of the bobbin end wall 21 so as to apply a rotational force tending to tighten the thread on the bobbin and to remove any slack.

Should a break occur in the bobbin thread 12, or should the thread become exhausted, bobbin 16 will no longer rotate, and therefore the optical sensor 25 will cease to produce a train of pulses. This is detected by unit 28, which unit will indicate this condition and/or effect an automatic operation of the sewing apparatus, such as stopping it to permit either manual replacement of another bobbin containing a fresh supply of thread, or automatic reloading of the apparatus with another bobbin.

The axially-extending strips 34 formed on the bobbin axle 23 serve two functions when thread is to be automatically rewound on the bobbin, of detecting the rotation of an empty bobbin, and also of catching the thread to be automatically wound on the bobbin. Such functions are particularly significant in an automatic system wherein, upon detecting an empty bobbin or one in which the thread has been broken, a control unit, indicated schematically at 28 in FIG. 1 and controlled by an optical sensor (not shown), automatically replaces the bobbin with a fresh bobbin containing a supply of thread, and also automatically rewinds the replaced bobbin with a fresh supply of thread.

Figure 5:
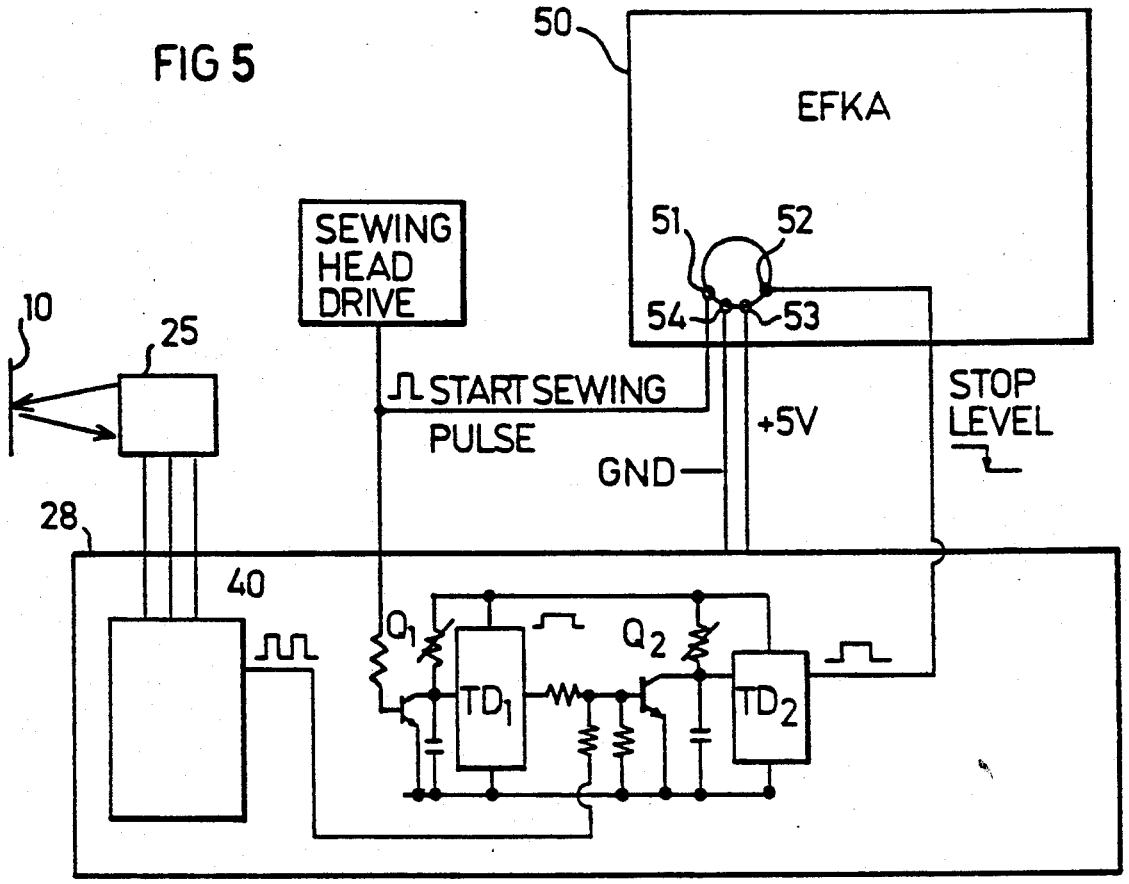
FIG. 5 is a block diagram illustrating one form of control system constructed in accordance with the invention for controlling sewing apparatus.

The system illustrated in FIG. 5 is particularly useful with respect to the lower bobbin thread monitoring system illustrated in FIGS. 1–4. Such a system incudes a monitoring device, designated 25 in FIG. 5 in the form of an optical sensor which senses the rotation of the lower bobbin and output a train of pulses in response to its rotation. Thus, failure of the monitoring device 25 to output a train of pulses indicates that the bobbin is not rotating, which in turn indicates either a thread-breakage condition or an end-of-thread condition, either of which conditions is to automatically terminate the operation of the sewing head drive.

The system illustrated in FIG. 5 further includes a control system, generally designated 28, which receives the output of the monitoring device 25 and is effective to automatically terminate the operation of the sewing head drive upon failure to receive the train of pulses from the monitoring device 25. Control system 28 includes a signal processor 40 receiving the train of pulses from the monitoring device 25. Signal processor 40 processes the train of pulses to remove noise, to amplify them, and to shape them into square pulses, so that so long as the monitoring device 25 outputs a train of pulses during the rotation of the bobbin, the signal processor 40 will output a corresponding train of square pulses derived from the pulses outputted from the monitoring device.

The control system 28 further includes two time delay circuits $TD_1$, and $TD_2$, each controlled by a transistor $Q_1$, $Q_2$, respectively. Thus, transistor $Q_1$ starts time delay circuit $TD_1$, and transistor $Q_2$ starts time delay circuit $TD_2$.

The system illustrated in FIG. 5 further includes a controller, generally designated 50, which controls the overall operation of the sewing apparatus. Such controllers are well-known, and therefore details of its construction are not illustrated, except its ports 51, 52, 53 and 54, which are involved in the overall operation of the apparatus as controlled by the control system 28.

Thus, port 51 outputs a "start pulse" accompanying the starting of the sewing head drive. This "start pulse" from port 51 may originate from a number of different sources, for example from the controller itself, from the foot pedal switch which starts a sewing operation, from the sewing head synchronizer, or from the upper thread breakage monitor; none of these is illustrated in the accompanying drawings for purposes of simplifying the description.

Port 52 of the controller 50 is connected to receive the "stop pulse" from the control system 28, particularly from its second time delay circuit $TD_2$, when the operation of the sewing head drive is to be automatically terminated upon failure of the lower bobbin to rotate, as detected by the monitoring device 25.

Ports 53 and 54 of controller 50 are merely connected to +5 volts and ground, respectively.

Port 51 which outputs the "start pulse", is connected to transistor $Q_1$ to start the time delay circuit $TD_1$ immediately upon receiving the start pulse. Upon the elaspse of the time interval ($t_1$) of that circuit, a pulse is outputted to transistor $Q_2$ of the second time delay circuit $TD_2$. Transistor $Q_2$ also receives the train of pulses from the signal processor 40. Thus, the second time delay circuit $TD_2$ is initiated to start timing only after the lapse of the predetermined time interval ($t_2$) of time delay circuit $TD_1$. The train of pulses from signal processor 40, as originally derived from the monitoring device 25 in response to the rotation of the bobbin, are effective to restart the predetermined time interval of time delay circuit $TD_2$ with each of the pulses received from the signal processor.

Thus, after receiving the initial "start pulse", the "stop pulse" from time delay circuit $TD_2$ will not be outputted until the elapse of times $t_1+t_2$, but during a sewing operation, a "stop pulse" will be outputted only the elapse of the time interval $t_2$ after the lower bobbin has ceased to rotate, thereby indicating a thread-breakage or an end-of-thread condition.

Figure 6:
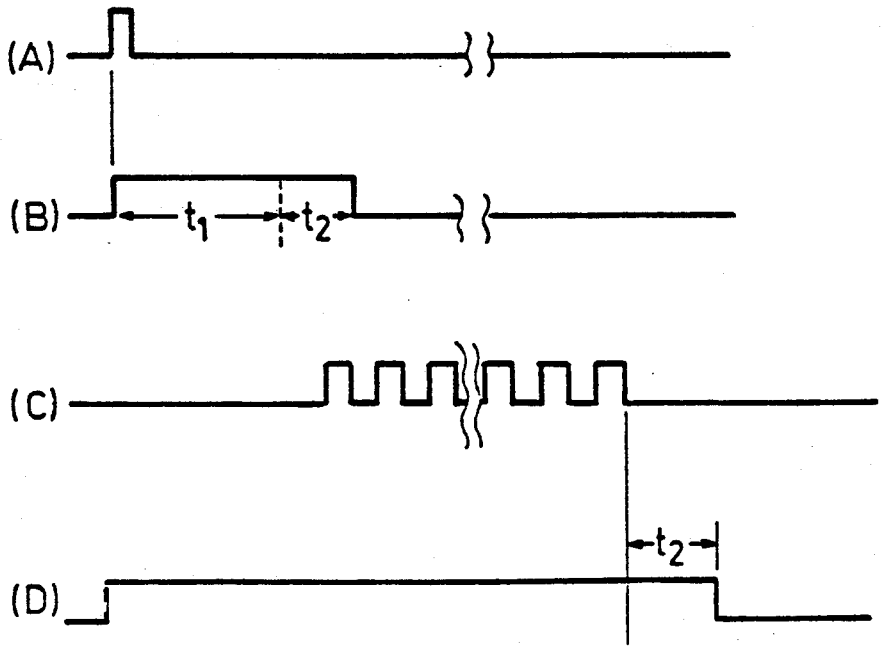
FIG. 6 is a timing diagram helpful in understanding the operation of the system of FIG. 1.

The overall operation of the system illustrated in FIG. 5 will be better understood by the timing diagram illustrated in FIG. 6.

Thus, when the sewing head drive is actuated to drive the sewing needle, a "start pulse" is outputted (waveform A) from port 51 of controller 50 to transistor $Q_1$ which starts the timing device $TD_1$. As indicated earlier, this "start pulse" may be produced by the controller, foot pedal switch, sewing head synchronizer, upper-thread breakage monitor, or in any other manner so as to accompany the actuation of the sewing head drive.

As soon as transistor $Q_1$ receives the "start pulse", timer $TD_1$ starts to operate, and after a predetermined time interval ($t_1$, e.g., 300 milliseconds) it actuates transistor $Q_2$ to start timer $TD_2$; thus, the output from the latter timer is a pulse equal to $t_1+t_2$ (waveform B).

Normally, during this time interval of $t_1+t_2$, the lower bobbin will start to rotate, to output a train of pulses as detected by monitoring device 25 (waveform C). These pulses are also applied to transistor $Q_2$, which transistor retriggers time delay $TD_2$, thereby restarting it to the beginning of its predetermined time interval. Accordingly, so long as these pulses are applied to transistor $Q_2$ from monitoring device 25, within time $t_1+t_2$ at the start, and within time $t_2$ thereafter, time delay circuit $TD_2$ will never run out, and therefore no "stop" pulse will be produced.

Such a "stop" pulse will therefore be produced from time delay circuit $TD_2$ to terminate the operation of the sewing head drive under the following circumstances:

(a) at the start of a sewing operation when the sewing head drive is first actuated, if times $t_1+t_2$ run out before a pulse is received from the monitor device 25 (via signal processor 28) indicated that the bobbin has started to rotate. This time delay (e.g., 300 milliseconds) is effective to permit the system to take-up the initial slack in the thread before enabling the monitoring device to terminate the operation of the sewing head drive when the bobbin does not rotate indicating a thread-breakage or an end-of-thread condition; and (b) during a sewing operation, if time $t_2$ runs out before a pulse is received from the monitoring device 25, this time delay (e.g., 150 milliseconds) being effective to accommodate any slack in the thread during a sewing operation.

Figure 7:
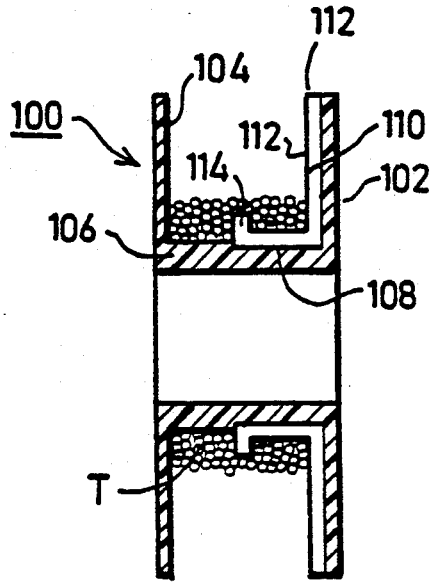
FIG. 7 is a sectional view illustrating one form of bobbin constructed in accordance with the present invention to prevent a break in a stitching operation.
Figure 8:
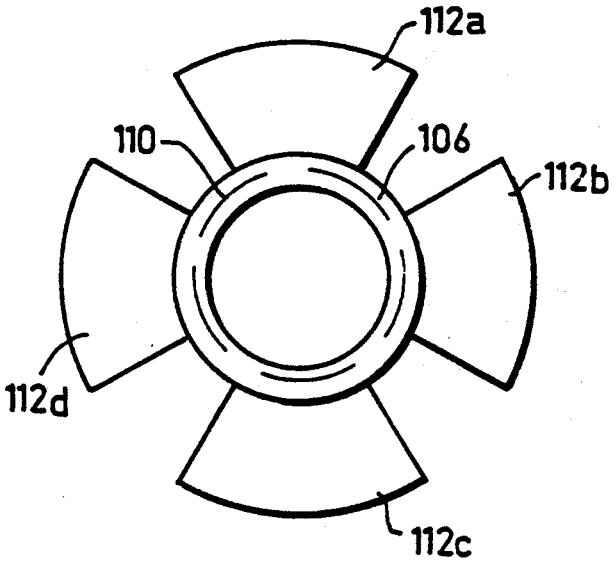
FIG. 8 is a side elevational view illustrating the mini-spool included in the bobbin of FIG. 7.

FIGS. 7 and 8 illustrate a bobbin construction particularly useful in the above-described aparatus of FIGS. 1–5, for preventing a break in a stitching operation which would normally occur by the non-rotation of the bobbin in the middle of a stitching operation. As mentioned earlier, the break produced in such an interruption is particularly unsightly in a "top stitch", such as when stitching collars, cuffs or pockets.

The bobbin illustrated in FIGS. 7 and 8, and therein generally designated 100, includes the normal pair of end walls 102, 104 interconnected at their centers by an axle 106 for receiving the thread T which is wound on the axle. Bobbin 100 illustrated in FIG. 7, however, further includes a rotatable mini-spool, generally designated 110, for receiving a predetermined length of the inner end of the thread, such that when the bobbin 100 stops rotating, the mini-spool 110 may continue to rotate and thereby to pay out part or all of the predetermined length of thread wound thereon in order to finish a stitching operation.

More particularly, axle 106 of bobbin 100 is formed with an annular recess 108 adjacent end wall 102 and terminating about mid-way of the distance to the opposite end wall 104. Mini-spool 110 is received within recess 108 such that the recess restrains the mini-spool 110 from moving axially of the bobbin (i.e., towards its end wall 104), while permitting the mini-spool to freely rotate on the bobbin axle.

Mini-spool 110 includes a large-diameter end wall 112 located adjacent to the bobbin end wall 102 and substantially of the same diameter as that end wall. Mini-spool 110 includes, at its opposite end, a small-diameter end wall 114 which is located about midway between the two bobbin end walls 102, 104, and is of a diameter substantially smaller than the diameter of bobbin end wall 104. "The diameter of the mini-spool end wall 114 is sufficiently large so as to receive the desired predetermined length of thread T to be wound thereon.

As shown particularly in FIG. 8, the large-diameter end wall 112 of mini-spool 110 is formed with a plurality of radially-extending sections, 112*a*–112*d*.

When bobbin 100 is loaded with thread, the inner end of the thread is first wound on mini-spool 110. The thread initially passes through the space between a pair of the sections 112*a*–112*d* of the mini-spool end wall 112, and thereby causes the mini-spool to rotate with the bobbin. When the diameter of the wound thread reaches that of the small-diameter end wall 114 of the mini-spool, the thread is then wound in the space between the mini-spool end wall 112 and the bobbin end wall 104. It will thus be seen that if the rotation of bobbin 100 is stopped because of what normally wound be an exhausted-thread condition, mini-spool 110 will still be able to rotate and to pay out its length of thread so as to complete the stitching operation at that time, thereby preventing the interruption of a stitching operation.

While the invention has been described with respect to one preferred embodiment, it will be appreciated that many other variations, modifications and applications of the invention may be made.

What is claimed is:

1. A sewing machine bobbin comprising a pair of end walls interconnected at their centers by an axle for receiving thread wound on the axle, characterized in that the bobbin includes a rotatable mini-spool rotatably mounted on said bobbin axle for receiving a predetermined length of the inner end of the thread such that when the bobbin stops rotating, said mini-spool may continue to rotate to pay out part or all of said predetermined length of thread thereon in order to finish a stitching operation, said rotatable mini-spool including one end wall of large diameter located adjacent one end wall of the bobbin, and a second end wall of small diameter spaced from the opposite end wall of the bobbin and of a diameter corresponding to the predetermined length of thread to be wound thereon.

2. A sewing machine bobbin comprising a pair of end walls interconnected at their centers by an axle for receiving thread wound on the axle; a rotatable mini-spool rotatably mounted on said bobbin axle for receiving a predetermined length of the inner end of the thread such that when the bobbin stops rotating, said mini-spool may continue to rotate to pay out part or all of said predetermined length of thread thereon in order to finish a stitching operation; said bobbin axle being formed with an annular recess at one side to receive said mini-spool and to restrain it from moving axially of the bobbin.

3. The bobbin according to claim 2, wherein said rotatable mini-spool includes one end wall of large diameter located adjacent one end wall of the bobbin, and a second end wall of small diameter spaced from the opposite end wall of the bobbin and of a diameter corresponding to the predetermined length of thread to be wound thereon.

4. The bobbin according to claim 3, wherein said large diameter end wall is formed of a plurality of radially-extending sections.

* * * * *